United States Patent [19]

Herzog et al.

[11] Patent Number: 4,798,658

[45] Date of Patent: Jan. 17, 1989

[54] DEVICE FOR THE CATHODIC CORROSION-PROTECTION OF METAL PARTS

[75] Inventors: Reinhold Herzog, Graz; Reinhard Padinger, St. Johann o.H.; Hans-Peter Rainer, Graz; Helmo Schober, St. Radegund, all of Austria

[73] Assignee: D 3 Cathodic Products-Korrosionsschutzprodukte Gesellschaft m.b.H., Austria

[21] Appl. No.: 37,352

[22] PCT Filed: Jul. 14, 1986

[86] PCT No.: PCT/AT86/00048

§ 371 Date: Apr. 24, 1987

§ 102(e) Date: Apr. 24, 1987

[87] PCT Pub. No.: WO87/00558

PCT Pub. Date: Jan. 29, 1987

[30] Foreign Application Priority Data

Jul. 12, 1985 [AT] Austria ..... 2063/85

[51] Int. Cl.[4] ..... C13F 13/00

[52] U.S. Cl. ..... 204/147; 204/228

[58] Field of Search ..... 204/147, 228

[56] References Cited

U.S. PATENT DOCUMENTS

| | | | |
|---|---|---|---|
| 3,498,898 | 3/1970 | Bogart et al. | 204/181 |
| 3,957,008 | 5/1976 | McCormick | 204/147 |

FOREIGN PATENT DOCUMENTS

| | | |
|---|---|---|
| 779914 | 2/1972 | Belgium . |
| 143722 | 10/1984 | European Pat. Off. . |
| 2736693 | 2/1978 | Fed. Rep. of Germany . |
| 3226146 | 1/1984 | Fed. Rep. of Germany . |

*Primary Examiner*—R. L. Andrews

*Attorney, Agent, or Firm*—Wegner & Bretschneider

[57] ABSTRACT

A device for the cathodic protection of metal parts in which electrodes and a voltage source are used to charge positively an electrolyte in relation to the metal surface which is to be protected. The electrodes (1) are so designed that they extend linearly and/or superficially over extensive areas of the metal surface to be protected.

23 Claims, 3 Drawing Sheets

Figure 1:
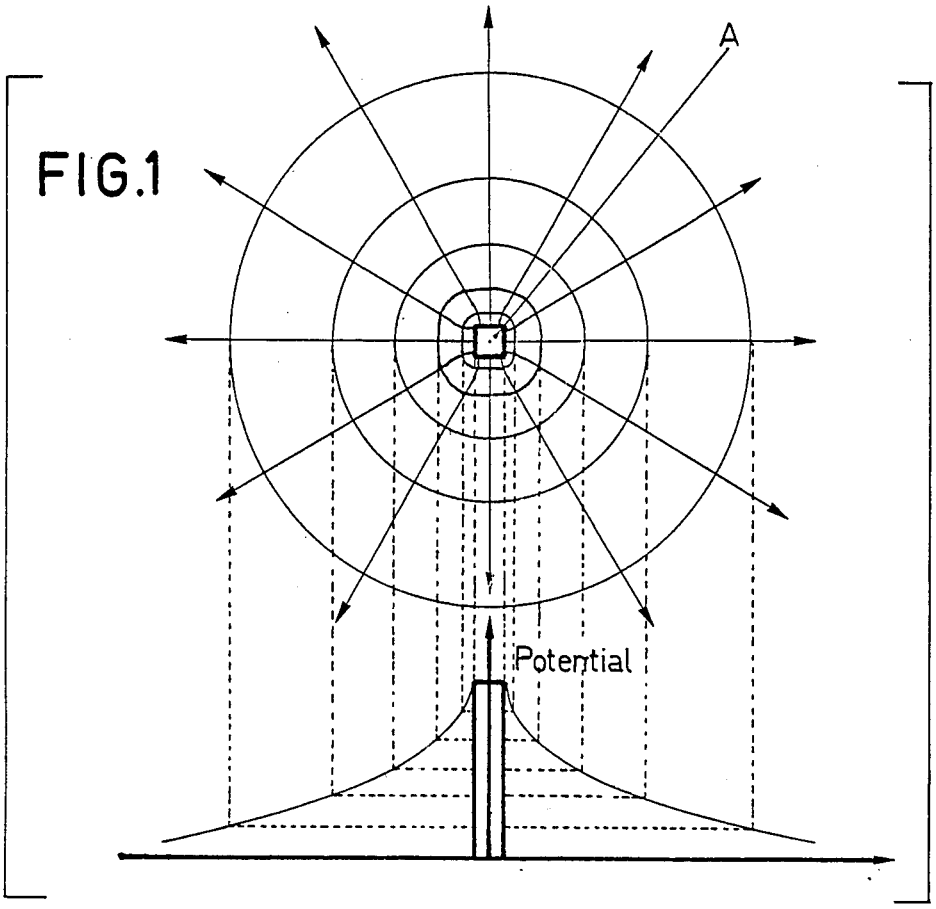

FIG. 4
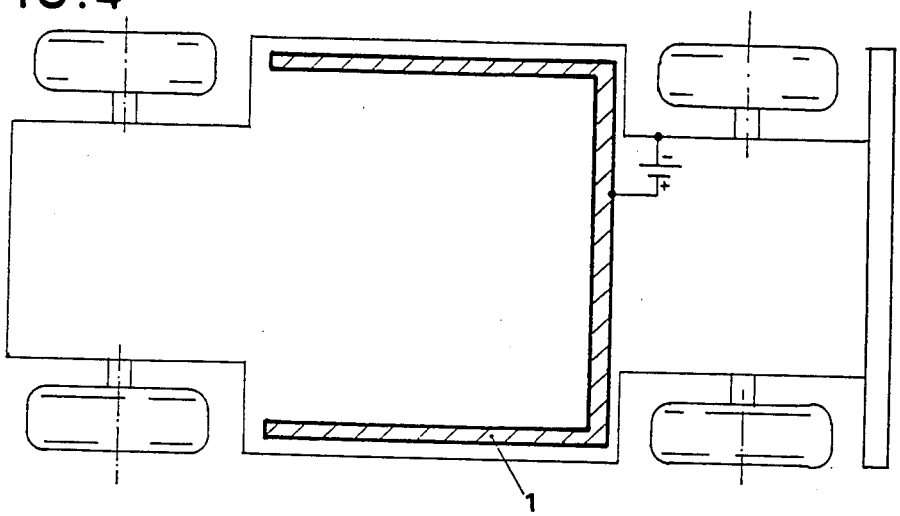
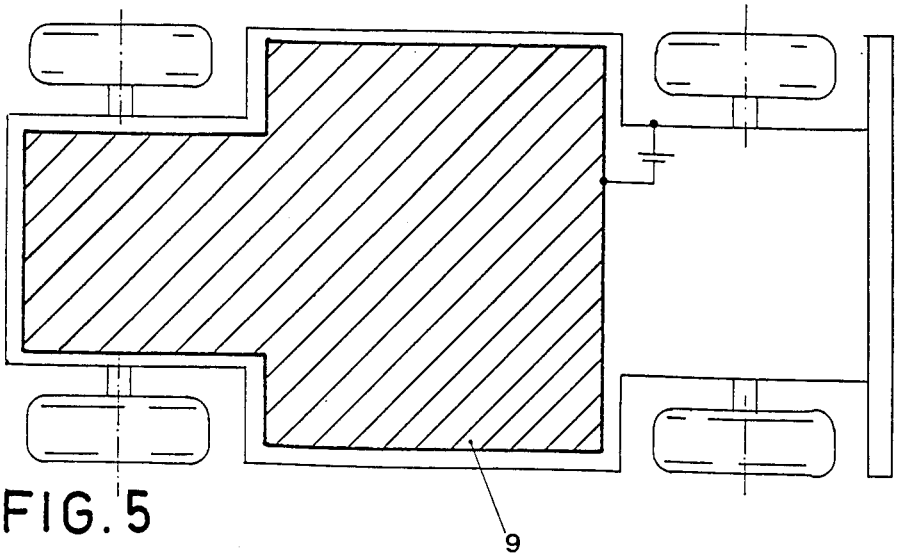
FIG. 5

DEVICE FOR THE CATHODIC CORROSION-PROTECTION OF METAL PARTS

Since the beginning of salt spreading on the roads for the prevention of snow and ice slipperiness, motor vehicles have been exposed to a considerable corrosion load. Rusted-through body and frame parts endanger the driving and operating safety of the motor vehicle and considerably shorten its useful life. By means of appropriate finishes or coatings (underbody protection, cavity protection), attempts are made nowadays to counteract the corrosion process.

Besides the mentioned "passive" corrosion-protection measures, however, there is also the possibility of "active" corrosion-protection by means of a direct current counteracting the corrosion.

This method, known by the name "cathodic corrosion-protection," has already been used for a long time for stationary installations (steel tanks, steel piping) and also for motor vehicles.

The invention relates to a device for the cathodic corrosion-protection of metal parts in which a potential difference is generated between the metal parts to be protected and any electrolyte located on the metal part by means of at least one electrode and at least one voltage source, so that at the places to be protected on the metal surface a direct current enters from the electrolyte into the metal surface, which counteracts the migration of positive metal ions from the metal surface. With such a device, one can simply connect the metal parts to be protected from corrosion, especially motor-vehicle parts, to the negative pole of a voltage source, and the positive pole of this voltage source to the cited electrode. The electrode is so mounted that it creates an electrically conductive connection to any electrolyte (moist dust, salt water, slush and the like) that might be loated on the surface of the metal parts to be protected, but a direct electrical connection of the electrodes to the metal parts to be protected is prevented by means of a suitably insulating layer (lacquer). With such an electrode one can thus raise the eletrolyte located on the surface of the metal parts to be protected to a positive potential with respect to the metal parts to be protected. The result of this is that, for example, at damaged places of a lacquer coating, as can occur for example due to mechanical actions, especially due to the impact of spread sand or the like, a direct current flows from the electrolyte into the metal surface, which counteracts the migration of positive metal ions from the metal surface and thus effects the so-called "cathodic corrosion-protection."

In this regard it is known that for the cathodic corrosion-protection to become effective, the potential of the electrolyte in the vicinity of the place to be protected, measured with respect to a $Cu/CuSO_4$ electrode, must be at least ca. 0.85 volts more positive than the potential of the metal to be protected.

While this requirement is relatively easy to satisfy for metal parts that are surrounded by an electrolyte having a large electrical flow cross-section (this applies especially for buried metal parts), for metal parts that are only covered with a thin electrolytic layer there is the problem that the potential decreases very rapidly with distance from the electrode, owing to the small electrical flow cross-section and the related high electrical resistance of the electrolyte, and already at a small distance from the electrode the value drops below the value required for the cathodic corrosion-protection to become effective. To be sure, an enlargement of the range of action could be achieved by raising the voltage of the electrode, but the feasibility of this measure is restricted for reasons of electrical effect and safety.

It is a goal of the invention to create a device of the aforesaid type with which a good protective action is attainable even at larger distances from the electrode(s) with relatively low values of the applied voltage.

The device of the aforesaid type according to the invention is characterized by the fact that for the protection of the surface of metal parts not buried in the ground, e.g., for the protection of metal parts of motor vehicles, the electrode coming into electrical connection with the electrolyte is applied linearly and/or superficially over wide regions on the metal surface to be protected. In this manner the above-cited goal can be accomplished well.

The invention provides for other advantageous refinements whose features are indicated in the subclaims.

The invention will now be further explained with reference to examples which are illustrated diagramatically in the drawing, also describing other features and advantages of the invention.

Figure 3:
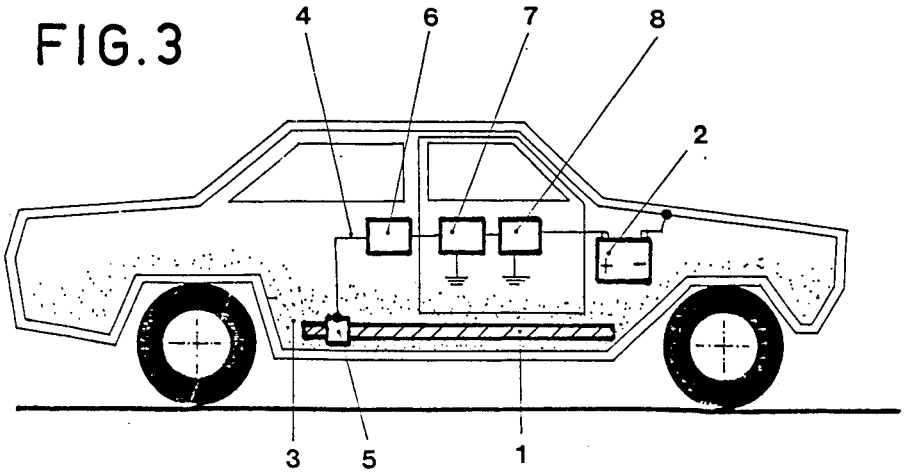
Figure 2:
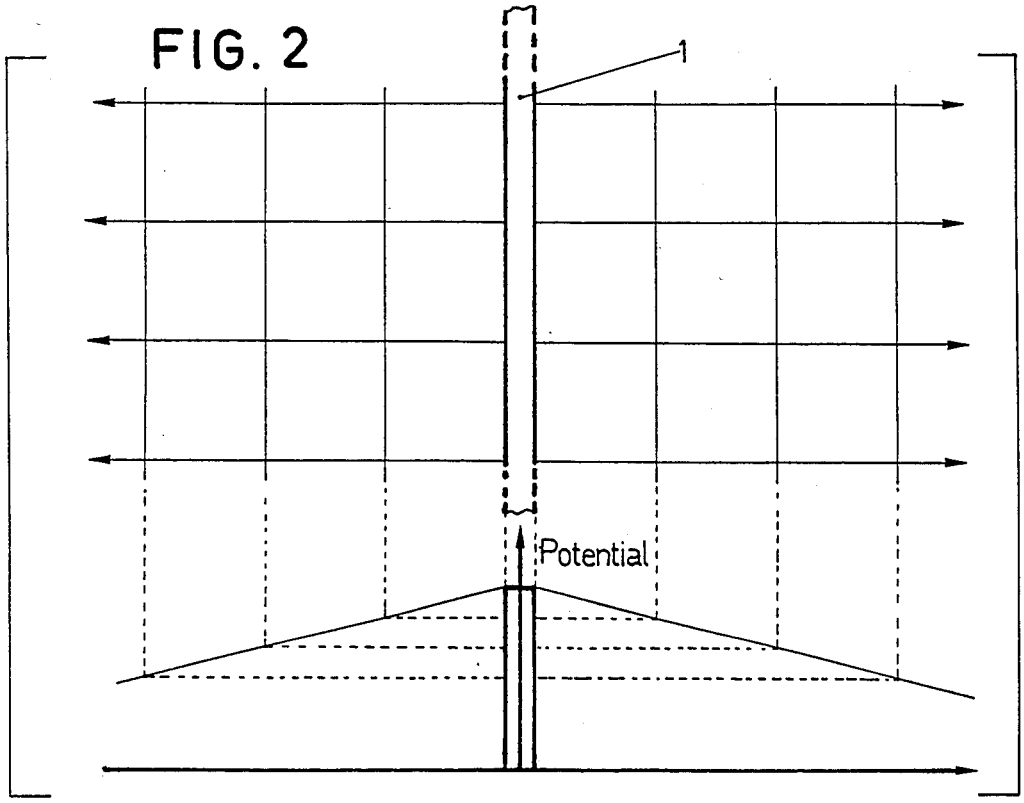
Figure 6:
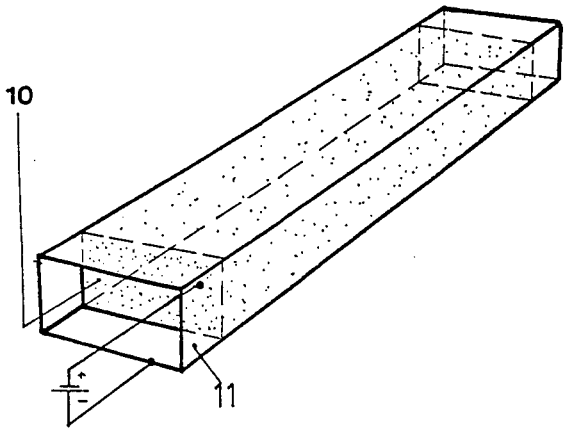

In the drawing,

FIG. 1 shows the flow field and potential variation that occur with devices used heretofore, FIG. 2 shows the flow field and potential variation with a device fashioned according to the invention, FIG. 3 shows an exemplary embodiment of a device according to the invention, and FIGS. 4, 5 and 6 show other exemplary embodiments with linearly extended electrode, superficially extended electrode and spatially extended electrode.

The electrodes used in the devices known heretofore are so fashioned that the cathodic protection current enters essentially centrally from the electrodes into the electrolyte and spreads out in the latter along essentially centrally running flow-lines, and as a result elevated current density and hence elevated voltage drops occur in the vicinity of the electrodes. Thus, conditions are present as are illustrated in FIG. 1 which shows the flow field and potential variation in the vicinity of an electrode A which is applied to an extended surface conductor and kept small in comparison to the surface conductor, with counterelectrodes at large distances. Owing to the elevated current density in the vicinity of the electrode, the potential of the surface conductor in the vicintiy of the electrode A decreases very rapidly.

The occurrence of elevated current densities and thus elevated voltage drops is avoided with the device according to the invention, and the region of action of the electrodes is thereby substantially enlarged in comparison to conventional electrodes. Used for this purpose, as shown for example in FIGS. 3 and 4, are elctrodes 1 which are linearly extended in at least one direction over wide regions of the metal surface to be protected, e.g., conductive adhesive strips or conductive trim strips, so that the current that emerges from them, as is made clear in FIG. 2, spreads out in the electrolyte in the vicinity of the electrodes along essentially parallel flow lines, and thus no elevated current densities and hence no elevated voltage drops occur. FIG. 2 shows the flow field and potential variation in the vicinity of an electrode 1 which is applied to an extended surface conductor and is linearly extended over a wide region of the surface conductor, with counterelectrodes at large distances. No elevated current density and hence no elevated voltage drop occurs in the vicinity of the electrode 1 (the ends of the electrode being excepted).

In a similar manner, used are electrodes 9 as in FIG. 5 which are superficially extended over wide regions of the metal surface to be protected, e.g., conductive coatings, especially conductive underbody protection or conductive cavity protection, or, as in FIG. 6, electrodes 10 which are spatially extended and which contact the metal parts to be protected superficially over wide regions, e.g., conductive fillers for cavities of the vehicle body.

The device according to the invention has at least one electrode which is applied to the metal surface to be protected, preferably glued or which can be applied as a coating or introduced into cavities. The electrode is so fashioned that it can be applied over wide regions extending in at least one direction on the metal surface to be protected or on a coating (lacquer) located on the metal surface. Linearly extended electrodes 1, or superficially extended electrodes 9 or spatially extended electrodes 10 come into consideration. The device further has an electrical connection line 4 with which the electrode can be connected to the positive pole of a voltage source 2.

The electrode is preferably made of a material which has no ionic conductivity at the interface with the electrolyte 3, e.g., graphite or a graphitized support material, e.g., graphitized rubber, so that they are not decomposed by the current like the known so-called "sacrificial anodes," or they are made of, for example, a metal and are surrounded by material which is not ionically conductive.

The electrodes can preferably be formed as flexible adhesive strips which can be easily cut into sections and can be applied to the surface of motor vehicles in a simple manner, they being able to be fitted to the contours of the motor vehicle and in this manner being able to extend linearly over wide regions of the metal surface to be protected.

The electrical connection of the electrode to the positive pole of a voltage source is effected, as shown in FIG. 3, by means of a connection line 4, preferably insulated, which is connectable at one end to the positive pole of a voltage source 2 and at the other end to the electrode, the connection 5 at the electrode preferably being effected via a previously described conductor which exhibits no ionic conductivity at the interface to the electrolyte 3.

The device is provided possibly with a known current limiter 6, preferably an electric resistor or an electric fuse, possibly with a known voltage limiter 7, preferably a voltage divider, and possibly with a known operation indicator 8, preferably a signal light.

FIG. 3 shows how a device according to the invention can be provided on a motor-vehicle body. FIG. 4 shows the application of a linearly extended electrode to a motor-vehicle underbody, and FIG. 5 shows the application of a superficially extended electrode to a motor-vehicle underbody. FIG. 6 shows the application of a spatially extended electrode 10 in a cavity of a motor-vehicle body, e.g., an entrance beam 11, with the electrode 10 contacting over a large area the metal parts which border the cavity.

We claim:

1. Device for the cathodic corrosion-protection of metal parts, in which a potential difference is generated between the metal parts to be protected and any electrolyte located on the metal part, so that at places to be protected on the metal surface a direct current enters from the electrolyte into the metal surface, which counteracts the migration of positive metal ions from the metal surface, wherein for the protection of the surface of metal parts not buried in the ground, said device comprises means for applying an essentially constant potential difference between the electrolyte and the metal surface over large areas of said metal surface, comprising an electrode and at least one voltage source, the electrode coming into electrical connection with the electrolyte being applied linearly and/or superficially over wide regions of the surface to be protected.

2. Device for the cathodic corrosion-protection of metal parts of a motor vehicle, in which a potential difference is generated between the metal parts to be protected and any electrolyte located on the metal part, so that at places to be protected on the metal surface a direct current enters from the electrolyte into the metal surface which counteracts the migration of positive metal ions from the metal surface, wherein said device comprises means for applying an essentially constant potential difference between the electrolyte and the metal surface over large areas of said metal surface, comprising an electrode and at least one voltage source, the electrode coming into electrical connection with the electrolyte being applied linearly and/or superficially over wide regions of the surface to be protected.

3. Device in accordance with claim 1 or 2, wherein the electrode is made of a material which has no ionic conductivity at the interface with the electrolyte, or is surrounded by such a material, so that the electrode is not decomposed by the direct current like a sacrificial anode.

4. Device in accordance with claims 1 or 2, wherein the electrical connection of the electrode to the positive pole of a voltage source is effected via a connection line which is connectable at one end to the positive pole of the voltage source and at the other end to the electrode, the connection at the electrode being effected via a connection part made of a material which exhibits no ionic conductivity at the interface to the electrolyte.

5. Device in accordance with claim 1 or 2, wherein a current limiter is provided in the circuit.

6. Device in accordance with claim 1 or 2, wherein a voltage limiter is connected before the electrode.

7. Device in accordance with claim 1 or 2, wherein the device has an operation indicator.

8. Device in accordance with claim 1 or 2, wherein the electrode is formed as a conductive adhesive strip.

9. Device in accordance with claim 1 or 2, wherein the electrode is formed as a conductive coating.

10. Device in accordance with claim 1 or 2, wherein the electrode is formed as conductive filler for cavities.

11. Device in accordance with claim 1 or 2, wherein the electrode is formed as a conductive strip.

12. Device in accordance with claim 1 or 2, wherein at edge-shaped structures of the metal parts to be protected, the electrode is bendable or is suitably bent or is independently elastically bent, so that it can be fastened thereto with suitable clamps.

13. Device in accordance with claim 1 or 2, wherein the electrode consists of protective trim.

14. Device in accordance with claim 1 or 2, wherein the electrode is made of graphite or a graphitized support material or is surrounded by such a material.

15. Device in accordance with claim 1 or 2, wherein the electrode is made of graphitized rubber, or is surrounded by such a material.

16. Device in accordance with claim 1 or 2, wherein an electric resistor is provided in the circuit.

17. Device in accordance with claim 1 or 2, wherein an electric fuse is provided in the circuit.

18. Device in accordance with claim 1 or 2, wherein a voltage divider is connected before the electrode.

19. Device in accordance with claim 1 or 2, wherein the electrode is formed as a conductive lacquer.

20. Device in acccordance with claim 1 or 2, wherein the electrode is formed as a conductive underbody protection.

21. Device in accordance with claim 1 or 2, wherein the electrode is formed as a conductive cavity protection.

22. Device in accordance with claim 1 or 2, wherein the electrode is formed as a conductive trim strip.

23. Device in accordance with claim 1 or 2, wherein the electrode consists of a lining of a metal part.

* * * * *